US006870157B1

(12) United States Patent
Zare

(10) Patent No.: US 6,870,157 B1
(45) **Date of Patent: *Mar. 22, 2005**

(54) TIME-OF-FLIGHT MASS SPECTROMETER SYSTEM

(75) Inventor: Richard N. Zare, Stanford, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/445,286

(22) Filed: May 23, 2003

Related U.S. Application Data

(60) Provisional application No. 60/383,476, filed on May 23, 2002.

(51) Int. Cl.[7] ..... H01J 49/40
(52) U.S. Cl. ..... 250/287; 250/281; 250/282
(58) Field of Search ..... 250/281, 282, 250/286, 287

(56) References Cited

U.S. PATENT DOCUMENTS

| | | | | |
|---|---|---|---|---|
| 4,707,602 A | * | 11/1987 | Knorr | 250/282 |
| 5,396,064 A | | 3/1995 | Wells | |
| 5,396,065 A | * | 3/1995 | Myerholtz et al. | 250/287 |
| 6,300,626 B1 | * | 10/2001 | Brock et al. | 250/287 |
| 6,455,845 B1 | * | 9/2002 | Li et al. | 250/287 |
| 6,664,545 B2 | * | 12/2003 | Kimmel et al. | 250/396 R |

OTHER PUBLICATIONS

"The New Time–Of–Flight Mass Spectrometry," Robert J. Cotter, *Analytical Chemistry News and Features,* Jul. 1, 1999, pp. 445A–451A.

"Fourier Transform Ion Mobility Spectrometry," F.J. Knorr et al., *Analytical Chemistry,* vol. 57, No. 2, Feb. 1985, pp. 402–406.

"Beam compression and beam multiplexing in a time–of–flight mass spectrometer," I. Riess, *Rev. Sci. Instrum.,* vol. 58, No. 5, May 1987, pp. 784–787.

"Fourier Transform Time–of–Flight Mass Spectrometry," F.J. Knorr et al., *Analytical Chemistry,* vol. 58, No. 4, Apr. 1986, pp. 690–694.

A miniature time of flight mass spectrometer, CA. Bailey et al., *Vacuum,* vol. 21, No. 10, Jul. 19, 1971, pp. 461–464.

"Hadamard Transform Time–of–Flight Mass Spectrometry," A. Brock et al., *Analytical Chemistry,* vol. 70, No. 18, Sep. 15, 1998, pp. 3735–3741.

"On the origin of spurious peaks in pseudorandom time–of–flight analysis," P. Zeppenfeld et al., *Rev. Sci. Instrum.,* vol. 64, No. 6, Jun. 1993, pp. 1520–1523.

"Use of a Correlation Chopper For Time of Flight Neutron Scattering(*), Part I: Theory of the Deconvolution," J.L. Buevoz et al., *Revue de Physique Appliquee,* vol. 12, Apr. 1977, pp. 591–596.

"Use of a Correlation Chopper For Time of Flight Neutron Scattering(*), Part II: Deconvolution in the Experimental Case," J.L. Buevoz et al., *Revue de Physique Appliquee,* vol. 12, Apr. 1977, pp. 597–602.

* cited by examiner

*Primary Examiner*—John R. Lee
*Assistant Examiner*—Paul M. Gurzo
(74) *Attorney, Agent, or Firm*—Parsons, Hsue & de Runtz

(57) ABSTRACT

An ion beam supplied from a source is modulated so the ions at a constant flux is deflected by different amounts during two different types of deflection time periods according to a binary sequence, in order to encode the ion beam with phase information of the sequence. The binary sequence is such that ions released during two consecutive time periods of the same type overlap before reaching a detector, thereby increasing the duty cycle. The detector output signal is demodulated using the phase information of the binary sequence to recover an ion mass spectrum.

26 Claims, 2 Drawing Sheets

TIME-OF-FLIGHT MASS SPECTROMETER SYSTEM

CROSS-REFERENCE TO RELATED APPLICATION

This application claims priority to provisional U.S. Patent Application Ser. No. 60/383,476 filed May 23, 2002. Provisional U.S. Patent Application Ser. No. 60/383,476 is incorporated herein by reference in its entirety.

BACKGROUND OF THE INVENTION

This invention relates in general to mass spectrometers and in particular to time-of-flight mass spectrometers.

Time-of-flight ("TOF") analysis has found widespread application because particle velocity, momentum, and mass can be determined from an experiment by constraining the appropriate parameters for the experiment. Time-of-flight mass spectrometers ("TOFMSs") have the very desirable characteristic of high ion transmission, high repetition rate, good resolution and modest cost, which makes them very attractive as a mass sensitive detector in analytical instrumentation. Such applications were until recently somewhat hampered by the fact that most analytical ion sources produce continuous ion beams. The pulsed operation of a conventional TOFMS causes a rather low duty-cycle and TOFMS could not live up to its promises. For more detailed description of the state of the art of TOFMS, please see "The New Time-Of-Fight Mass Spectrometry," by Robert J. Cotter, *Analytical Chemistry News and Features*, Jul. 1, 1999, pages 445A–451A.

It is desirable for an interface design between a continuous ion source and a TOFMS to overcome two problems. One is bringing the ions with as little spatial and kinetic energy spread as much as possible into the spectrometer for the purpose of achieving high mass resolution. The other is using as many of the ions supplied by the continuous source as possible without compromising on the first requirement so that a high duty-cycle can be achieved. Today, the preferred and highly refined solution to these problems is orthogonal acceleration ("OA). See "Time-of-Flight Mass Spectrometry," R. J. Cotter, *ACS Symposium Series* 547. By OA, it is meant that the ion beam emanating from the ion source enters the TOF instrument at a right angle with respect to the flight axes of the ions in the spectrometer. This geometry allows a low spatial and kinetic energy spread to be achieved. The duty-cycle objective is met by expanding the width of the extraction region so that a larger fraction of the ion beam coming fro the source can be sampled. Active ion storage can be achieved by accumulation of ions in an ion guide connecting ion source and extraction region during the time an extracted ion packet disperses in the instrument.

In U.S. Pat. No. 5,396,064, Myerholt et al. describe a multiplexing procedure using a conventional TOF instrument in which an extraction region involving a pair of grids is pulsed and a cross-correlation is carried out numerically. This scheme, however, is still seriously impaired in practice by the difficulty of implementing a procedure using a pair of grids and parameters allowing for space focusing. A conventional space-focusing type of TOFMS is difficult to operate in a full multiplexing mode over an extended mass range. The pair of grids cannot be pulsed sufficiently rapidly to accomplish this objective because of the time it takes for ions to drift into the region between the grids, Moreover, this drift, of course, is mass dependent. For this reason, space focusing, which requires an extraction region defined by more than one grid, is undesirable.

None of the above-described TOFS schemes are entirely satisfactory for measuring ions. It is therefore, desirable to provide an improved TOFMS technique where the above-described difficulties are avoided.

SUMMARY OF INVENTION

At least one beam of ions is modulated by deflecting the beam by different amounts during two different types of deflection periods according to a sequence to encode the beam with phase information of the sequence. The times of arrival of ions in the deflected beam are detected by one or more detectors, where ions passed during at least two consecutive deflection periods of the same type overlap prior to reaching the detector(s). The detector(s) supplies or supply one or more output signals in response to the deflected beam. The output signal(s) is demodulated using the phase information to obtain an ion mass spectrum.

Preferably the beam comprises a substantially continuous beam of ions of preferably substantially constant flux. In one embodiment, the beam is deflected by a first amount during first deflection periods and by a second amount different from the first during second deflection periods according to a binary sequence.

Where the beam is detected by a detector during only one of the two deflection periods, a duty cycle close to or equal to 50% can be achieved. Where the beam is detected during both deflection periods, such as by means of two different areas of the same detector, or by two different detectors, a duty cycle of 100% or close to it can be achieved. Alternatively, during only one of the two deflection periods, the beam can be simply blocked, thereby achieving a 50% duty cycle.

If a plurality of ion sources are employed, each providing a beam of ions, then a plurality of detectors may be accommodated within the same chamber for performing ion mass spectroscopy of the ions from the plurality of ion sources. In one embodiment, the same modulator may be employed to modulate the plurality of beams from the plurality of ion sources according to a sequence to encode the beams with phase information of the sequence. This reduces space and cost requirements.

BRIEF DESCRIPTION OF THE DRAWINGS

For simplicity and description, identical components are labeled by the same numerals in this application.

DETAILED DESCRIPTION OF THE EMBODIMENTS

Figure 1:
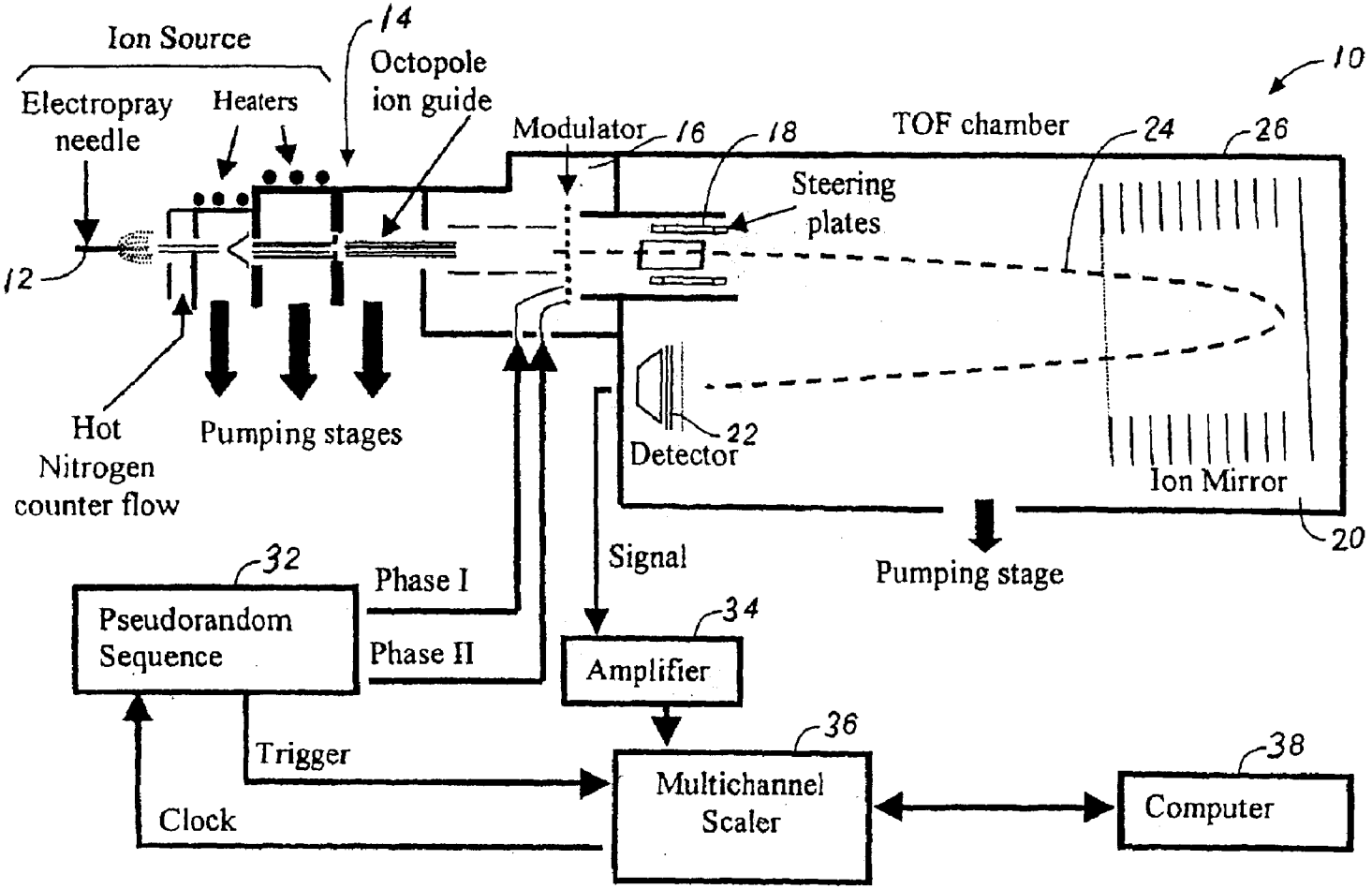
FIG. 1 is a block diagram of a TOFMS apparatus to illustrate one embodiment of the invention.

FIG. 1 is a block diagram of TOFMS system 10 to illustrate one embodiment of the invention with an electrospray ionization source 12. Ions supplied by an electrospray needle 12 are passed through pumping stages equipped with heaters, and hot nitrogen counterflow, an octopole ion guide 14. Ions are accelerated after the ion guide to reach a modulator 16 comprising an array of elongated electrical conductors (such as a linear array of wires). Preferably the conductors are arranged in a plane orthogonal to the direction of the ion beam emanating from the pumping stage or octopole ion guide 14, although in another embodiment, the conductors may be arranged in a non-orthogonal plane or in multiple planes. After passing through the modulator 16, the preferably parallel beam is steered with the help of two sets of deflection plates 18, through the ion mirror 20 and onto the detector 22.

In a manner different from the prior art scheme in the patent to Myerholtz et al. described above, when the ion beam is passed by the modulator 16, ions from the beam from pumping stage 14 are deflected by different amounts during two types of deflection periods in accordance with a sequence. In one embodiment, the ion beam is deflected in accordance with a binary sequence, where the two types of deflection periods may be referred to as "on" and "off" periods.

Thus when the ion beam is modulated in accordance with a binary sequence, for example, where the value in the sequence is of one value such as "1," the ion beam is deflected by a first amount, and where the ion beam is of the other value such as "0," the ion beam is deflected by a second amount different from the first amount. Thus, for the value "1" in the sequence, the ion beam is deflected by the first amount during a first type of deflection time periods and when the values in the binary sequence are of the value "0," the ion beam is deflected by the second amount during a second type of time periods. For easy reference, the first type of deflection periods may be referred to as on periods and the time periods during which the ion beam is deflected by the second amount may be referred to as the off periods, although obviously, the labels can be switched so that the off time periods correspond to the value "1" in the binary sequence and the on periods correspond to the value "0" in the sequence.

In one embodiment, detector 22 in TOFMS system 10 is located such that during the on periods, the ion beam is deflected by the modulator 16 by a first amount to land on an area of the detector 22, and during the off periods, the beam is deflected by a different amount by the modulator so that it does not land in such area. If only the ions during the on period are counted by the detector, as in the embodiment described immediately above, a 50% duty cycle is achieved. If the ions during the off periods are also directed to a different active area of the same detector such as in an imaging detector, or directed to a different detector (not shown), a duty cycle of 100% or close to it may be achievable. The above-described designated area or areas of the detector may be achieved by putting a spatial filter having one or more slits therein in front of the detector or detectors so that only the designated area or areas of the detector(s) is exposed to the ion beam during the on and off periods. For simplicity, such filter is not shown in FIG. 1.

Alternatively, the ions in the beam during the off periods may be deflected or blocked by a physical object such as a shutter (not shown), where the beam is deflected during the on periods and detected by a detector. In such embodiment, a 50% duty cycle is achieved.

Modulator 16 may be implemented by means of a linear array of elongated electrical conductors or electrodes, such as metal wires, arranged in one or more planes preferably orthogonal to the direction of the ion beam. Appropriate electrical potentials are applied to the conductors to control the on and off periods. In one embodiment, during the on period, a first set of electrical potentials is applied to the set of electrical conductors and during the off period, a second set of electrical potentials different from the first set are applied to the conductors so that the ion beam is deflected by different amounts during the on and off periods.

Preferably, the sets of the electrical potentials applied to the conductors are such that adjacent electrodes or conductors are at potentials of opposite polarity. This may be accomplished by toggling each electrode between two potentials, such as a positive voltage and a negative voltage. In some embodiments, the potentials applied to adjacent electrodes or conductors may have the same magnitude but are of opposite polarities, so that at a distance, the potentials applied to the electrodes or conductors will not affect the oncoming ion beam at a distance where that beam would experience no net electrical field so that such electrical potentials would not adversely affect the path of the ions during a subsequent different deflection period; this increase the accuracy of the measurements. However, this is not required for certain applications where this is not a significant factor, so that the potentials applied to adjacent electrodes or conductors may have different magnitudes. The following are two possible sets of a first and a second electrical potential that may be employed to implement the invention:

I. a) "ON" state: electrode 1 10V electrode 2 −10V b) "OFF" state: electrode 1 −10V electrode 2 +10V or II. a) "ON" state: electrode 1 10V electrode 2 −10V b) "OFF" state: electrode 1 −5V electrode 2 +5V.

In yet other embodiment, only one conductor or electrode in each pair of adjacent conductors may be toggled between two potentials.

It is found that for small deflection angles, the deflection angle is proportional to the deflection voltages applied to the conductors in modulator 16. First if detector 22 is located so as to detect the ion beam during the on period, using the information that the deflection angle is proportional to the deflection voltage at small deflection angles, a different area of the detector 22, or a separate detector (not shown) adjacent to detector 22, may be used and located for detecting the ions during the off time periods so as to achieve a duty-cycle off 100% or close to it.

The steering plates 18, ion mirror 20, detector 22 and the path of the ions 24 are enclosed by a TOF chamber 26. A pseudorandom binary sequence in generated by a generator 32 and the appropriate voltages corresponding to the sequence are applied to the set of conductors in modulator 16; for simplicity, the connections from generator 32 to only two of the wires or conductors in the linear array in modulator 16 are shown in FIG. 1. The multi-channel scaler 36 supplies a clock signal to generator 32 which, in turn, supplies a trigger signal to the multi-channel scaler 36 to signal the start of the sequence. Multi-channel scaler 36 counts by the amplified output of the detector 22 (and the output of another detector or another area of the same detector 22) by amplifier 34 into time bins of integral fraction of unit time. Such counts are then sent to a computer or processor 38 for performing the demodulation calculations in order to derive the ion mass spectrum in a manner best described in U.S. Pat. No. 6,300,636. The calculations may include, for example, forming a correlation matrix from the binary sequence and deconvolving the output signal with the matrix to obtain the mass spectrum, such as by performing an inverse Hadamard transform on the output signal. While a computer is used for this purpose to FIG. 1, other types of electronic circuits may be used not within the scope of the invention. Generator 32 in multi-channel scaler 36 may be constructed in a conventional manner.

Figure 2:
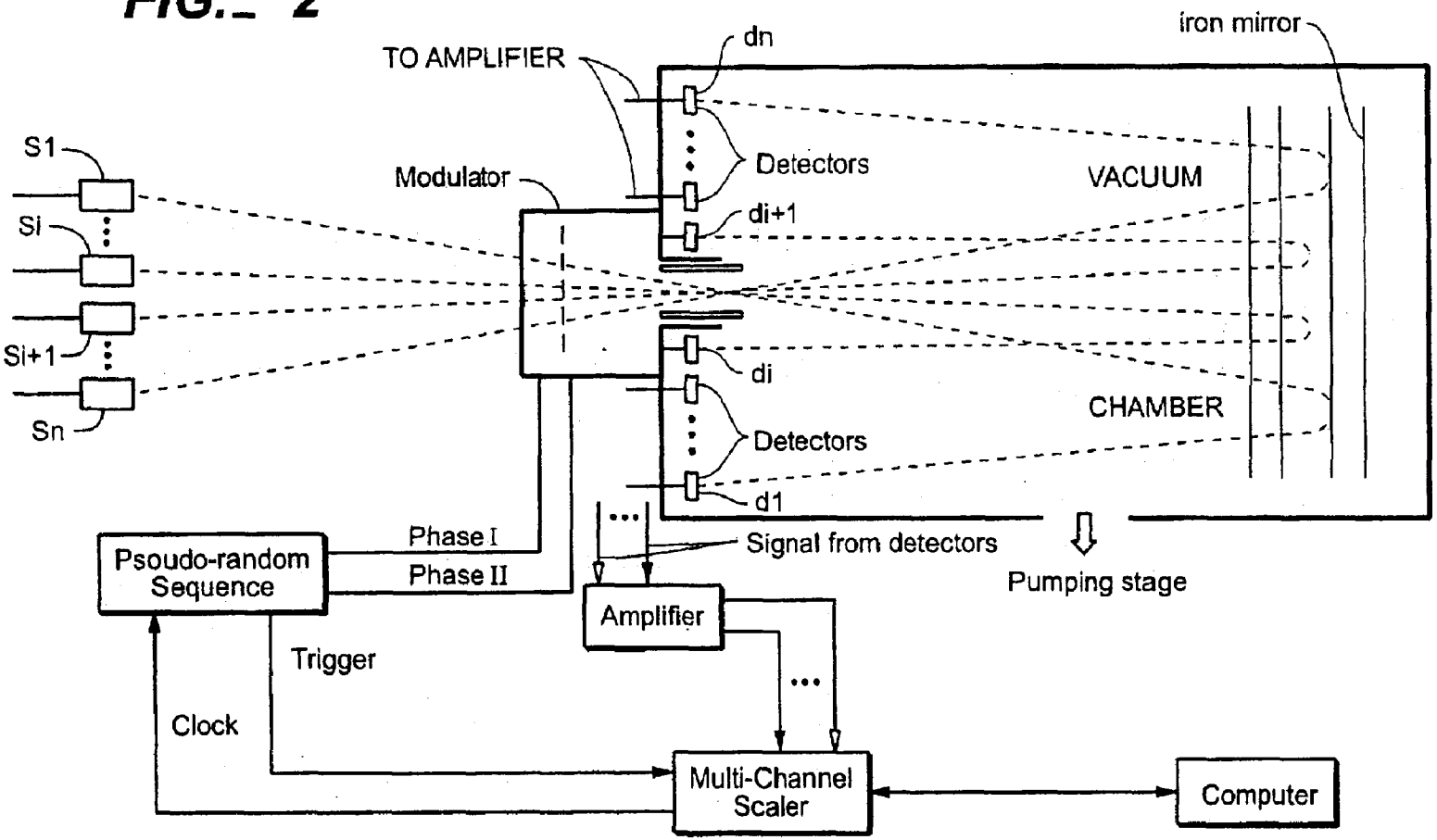
FIG. 2 is a block diagram a TOFMS apparatus to illustrate another embodiment of the invention where multiple TOFMS share a common modulator and chamber.

Major considerations in analytical instrumentation are space and cost. For these reasons, it may be desirable to provide an apparatus with a plurality of HT-TOFMS systems within the same vacuum chamber, reducing space requirements and costs as compared to the same number of individual mass spectrometers employed at the same time. A possible embodiment of such an apparatus is shown in FIG. 2 where multiple systems share the same vacuum chamber. The ion beams entering the common vacuum housing are arranged more or less in parallel, although other arrangements are possible. In this arrangement, each of the HT-TOFMS systems comprises an ion source $S_i$, I ranging from 1 to N, N being the total number of systems occupying the same housing, a modulator, and ion mirror, a detector $D_i$, and a waveform recorder. Besides sharing the vacuum envelope, the modulator and the ion mirror are shared in this arrangement. Alternatively, a plurality of modulators (not shown in FIG. 2) may be employed for modulating the substantially parallel beams, preferably with a few beams modulated by each individual modulator, or where each beam is modulated by a different modulator. Such and other variations are within the scope of the invention. The plurality of modulators may be controlled by the same modulation and timing control electronics. The beams and modulators may share the same vacuum chamber. The ion sources $S_i$ are not necessarily of the same type or use the same ionization mechanism to achieve the end individual ion streams. The embodiment in FIG. 2 achieves also economy in the necessary pumping capacity to maintain the vacuum in the shared time-of-flight region, because all the beams enter through the same hole into the vacuum chamber. The ion beam from ions source $S_i$ will be directed towards a corresponding detector $D_i$. As seen in FIG. 2, all of the N beams are modulated by the same modulator, which is controlled by the pseudorandom sequence generator in the same manner as was described above in reference to FIG. 1. The end outputs of detectors $D_i$, are simultaneously but separately recorded by a single waveform recorder having inputs of multiple waveform recorders providing the proper number of inputs, after having likewise been amplified. Synchronization of modulation and data acquisition is achieved in this same fashion as described in FIG. 1. A single computer is sufficient to control data acquisition and collection, as well as to transform the end signal wave forms into end spectra. In this matter, the ions from a plurality of sources may be analyzed simultaneously and only a single vacuum chamber may be used for housing the systems. While preferably all of the ion beams from the polarity of sources are passed through the same hole and are modulated by the same modulator, it will be understood that a different ion beams can pass through separate holes with each beam being modulated by a dedicated modulator only used for modulating such a beam.

While the invention has been described above by reference to different embodiments, it will be understood that changes and modifications may be made without departing from the scope of the invention which is to be defined only by the appended claims and their equivalents. Thus, which in the embodiments above a source providing a substantially continuous beam of ions is used, it may also be possible to employ other types of sources. The modulator can be controlled so that during the on periods or at least a portion thereof, the modulator beam has a substantially constant flux.

While the invention above has been described by reference to embodiments where the ion beam is modulated in accordance with a binary sequence, it will be understood that the ion beam may be modulated in accordance with the sequence which is other than binary; such other variation is within the scope of the invention.

All references referred to herein are incorporated by reference in their entireties.

What is claimed is:

1. A method for analyzing ions by determining times of flight of the ions, comprising:

providing at least one beam of ions;

deflecting the at least one beam by different amounts according to a binary sequence to encode the at least one beam with phase information of the binary sequence comprising deflection periods of two different types;

detecting the times of arrival of ions at a detector, wherein ions deflected during at least two consecutive periods of the binary sequence of the same type may overlap prior to reaching the detector, said detector supplying an output signal in response to the deflected at least one beam; and demodulating the output signal using said phase information to obtain an ion mass spectrum.

2. The method of claim 1, wherein said detector is located so that when the at least one beam is deflected by a first amount during deflection periods of a first type defining on periods, the ions in the beam are directed to a first active area of the detector, and when the beam is deflected by a second amount during deflection periods of a second type defining off periods, the beam is directed away from the first active area of the detector.

3. The method of claim 2, wherein when the beam is deflected during the off periods, the beam is directed towards at least a second active area of the detector or another detector.

4. The method of claim 2, said grid structure comprising an array of elongated electrical conductors in a plane, wherein said deflecting includes causing said conductors to be at two different sets of electrical potentials during the on and off periods.

5. The method of claim 4, wherein said deflecting includes causing the electrical potentials of each pair of adjacent conductors during the on and off periods to be different.

6. The method of claim 5, wherein said deflecting includes causing the electrical potentials of each pair of adjacent conductors during the on and off periods to be of equal amplitude but of opposite polarity.

7. The method of claim 5, wherein said deflecting includes causing the electrical potentials of the conductors of each pair of adjacent conductors to toggle in opposite phase between two electrical potentials, and wherein during the on and off periods, electrical potentials of different amplitudes are applied to the conductors.

8. The method of claim 7, wherein said deflecting includes causing the electrical potentials of only one conductor of each pair of adjacent conductors to toggle between two electrical potentials.

9. The method of claim 1, wherein said processing forms a correlation matrix from said binary sequence, and deconvolves said output signal with said matrix to obtain the mass spectrum.

10. The method of claim 1, wherein said demodulating includes performing an inverse Hadamard transform on the output signal to obtain the mass spectrum.

11. An apparatus for analyzing ions by determining times of flight of the ions, comprising:

an ion source providing at least one beam of ions;

a modulator deflecting the at least one beam by different amounts during deflection periods of two different types according to a binary sequence to encode the at least one beam with phase information of the binary sequence;

a detector detecting the times of arrival of ions in the deflected at least one beam, wherein ions passed during at least two consecutive deflection periods of the same type may overlap prior to reaching the detector, said detector supplying an output signal in response to the deflected at least one beam; and a processor demodulating the output signal using said phase information to obtain an ion mass spectrum.

12. The apparatus of claim 11, wherein said modulator includes a grid structure that deflects the at least one beam during deflection periods of a first type defining on periods, and during deflection periods of a second type defining off periods, and a power source supplying to the grid structure a sequence of signals corresponding to the binary sequence to modulate the at least one beam.

13. The apparatus of claim 12, wherein said grid structure includes an array of elongated electrical conductors arranged substantially in a plane.

14. The apparatus of claim 13, wherein said plane is substantially perpendicular to the at least one beam.

15. The apparatus of claim 13, wherein said deflecting causes said conductors to be at two different sets of electrical potentials during the on and off periods.

16. The apparatus of claim 13, wherein said modulator causes the electrical potentials of each pair of adjacent conductors during the off periods to be different.

17. The apparatus of claim 16, wherein said modulator causes the electrical potentials of each pair of adjacent conductors during the on and off periods to be of equal amplitude but of opposite polarity.

18. The apparatus of claim 16, wherein said modulator causes the electrical potentials of the conductors of each pair of adjacent conductors to toggle at opposite phase between two electrical potentials.

19. The apparatus of claim 16, wherein said modulator causes the electrical potentials of only one conductor of each pair of adjacent conductors to toggle between two electrical potentials.

20. The apparatus of claim 11, said detector having a first active area, wherein said detector is located so that when the at least one beam is deflected by a first amount during the on periods, the ions in the at least one beam are directed to the first active area of the detector, and when the at least one beam is deflected by a second amount during the off periods, the at least one beam is directed away from the first active area of the detector.

21. The apparatus of claim 20, said detector having at least a second active area, wherein during the off periods, the at least one beam is directed towards the at least second active area of the detector.

22. The apparatus of claim 20, wherein during the off periods, the at least one beam is directed towards another detector.

23. The apparatus of claim 11, wherein said processor performs an inverse Hadamard transform on the output signal to obtain the mass spectrum.

24. The apparatus of claim 11, wherein said processor forms a correlation matrix from said binary sequence, and deconvolves said output signal with said matrix to obtain the mass spectrum.

25. An apparatus for analyzing ions by determining times of flight of the ions, comprising:

means for providing a continuous beam of ions of substantially constant flux;

means for deflecting the beam by different amounts according to a sequence to encode the beam with phase information of the sequence;

means for detecting the times of arrival of ions in the deflected beam at a detector, wherein ions passed during at least two consecutive similarly-deflected periods overlap prior to reaching the detector, said detector supplying an output signal in response to the deflected beam; and means for demodulating the output signal using said phase information to obtain an ion mass spectrum.

26. A method for analyzing ions by determining times of flight of the ions, comprising:

providing a continuous beam of ions of substantially constant flux;

deflecting the beam by a first amount during first deflection periods and by a second amount during second deflection periods according to a sequence to encode the beam with phase information of the sequence;

detecting times of arrival of ions in the deflected beam at a detector, wherein ions passed during at least two consecutive first periods overlap prior to reaching the detector, said detector supplying an output signal in response to the deflected beam; and demodulating the output signal using said phase information to obtain an ion mass spectrum.

* * * * *